US010920789B2

(12) United States Patent
Zhang et al.

(10) Patent No.: US 10,920,789 B2
(45) Date of Patent: Feb. 16, 2021

(54) FUME EXHAUST ASSEMBLY AND FUME EXHAUST DEVICE

(71) Applicant: MIDEA GROUP CO., LTD., Foshan (CN)

(72) Inventors: Jizhe Zhang, Foshan (CN); Hui Zhang, Foshan (CN)

( * ) Notice: Subject to any disclaimer, the term of this patent is extended or adjusted under 35 U.S.C. 154(b) by 196 days.

(21) Appl. No.: 16/228,689

(22) Filed: Dec. 20, 2018

(65) Prior Publication Data

US 2019/0128283 A1 May 2, 2019

Related U.S. Application Data

(63) Continuation of application No. PCT/CN2017/084771, filed on May 17, 2017.

(30) Foreign Application Priority Data

Dec. 27, 2016 (CN) ..... 201611227987.6

(51) Int. Cl.
*F04D 29/54* (2006.01)
*F04D 29/64* (2006.01)
(Continued)

(52) U.S. Cl.
CPC ..... *F04D 29/547* (2013.01); *F04D 29/522* (2013.01); *F04D 29/646* (2013.01);
(Continued)

(58) Field of Classification Search
CPC .... F04D 29/547; F04D 29/646; F04D 29/522; F04F 5/466; F04F 5/42; F04F 5/16;
(Continued)

(56) References Cited

U.S. PATENT DOCUMENTS 1,527,849 A * 2/1925 Elliott ..... F23L 17/16 110/162
1,612,838 A * 1/1927 Schutz ..... F04F 5/42 417/194
(Continued)

FOREIGN PATENT DOCUMENTS

CN 2125750 U 12/1992
CN 2384114 Y 6/2000
(Continued)

OTHER PUBLICATIONS

OA for KR application 10-2018-7037112.
(Continued)

*Primary Examiner* — Jorge A Pereiro
(74) *Attorney, Agent, or Firm* — Kilpatrick Townsend & Stockton, LLP

(57) ABSTRACT

A fume exhaust assembly and a fume exhaust device are provided. The fume exhaust assembly includes a fan, a vortex generating portion, a fume intake pipe, and a fume exhaust pipe. The vortex generating portion includes a vortex pipe and an air intake channel. The air intake channel is in communication with the vortex pipe, an inlet of the air intake channel is connected to the fan, and an outlet of the air intake channel is configured to generate a vortex updraft in the vortex pipe. The fume intake pipe and the fume exhaust pipe are in communication with the vortex pipe. An outlet of the fume intake pipe is arranged above the outlet of the air intake channel. The outlet of the fume intake pipe is configured to be in communication with a low-pressure zone of the vortex updraft. The fume exhaust pipe is connected to an outlet of the vortex pipe.

11 Claims, 4 Drawing Sheets

(51) Int. Cl.

| | |
|---|---|
| ***F04D 29/52*** | (2006.01) |
| ***F04F 5/46*** | (2006.01) |
| ***F04F 5/42*** | (2006.01) |
| ***F24C 15/20*** | (2006.01) |
| ***F04F 5/16*** | (2006.01) |

(52) U.S. Cl.
CPC ..... *F04F 5/16* (2013.01); *F04F 5/42* (2013.01); *F04F 5/466* (2013.01); *F24C 15/20* (2013.01); *F05D 2210/43* (2013.01); *F05D 2260/95* (2013.01)

(58) Field of Classification Search
CPC .. F24C 15/20; F05D 2260/95; F05D 2210/43; F24F 13/08; F24F 2221/46
USPC ..... 126/299 R–307 A
See application file for complete search history.

(56) References Cited

U.S. PATENT DOCUMENTS

| | | | | | |
|---|---|---|---|---|---|
| 2,096,765 | A * | 10/1937 | Saha | F23D 1/00 | 110/264 |
| 2,368,827 | A * | 2/1945 | Hanson | C09C 1/50 | 422/156 |
| 2,413,586 | A * | 12/1946 | Skoog | C09C 1/50 | 422/158 |
| 2,560,069 | A * | 7/1951 | Bloomer | B01F 5/0451 | 48/180.1 |
| 2,590,660 | A * | 3/1952 | Skoog | C09C 1/50 | 422/150 |
| 3,567,399 | A * | 3/1971 | Altmann et al. | F23G 7/065 | 422/183 |
| 3,570,423 | A * | 3/1971 | Hemmingson | F24C 15/20 | 110/160 |
| 3,577,940 | A * | 5/1971 | Hasselbring | F23G 5/32 | 110/216 |
| 3,658,017 | A * | 4/1972 | Dibelius | F23G 5/32 | 110/216 |
| 3,695,192 | A * | 10/1972 | Von Brimer | F23J 11/00 | 110/203 |
| 3,857,651 | A * | 12/1974 | Bruno | F04F 5/26 | 417/171 |
| 3,868,210 | A * | 2/1975 | Simpson | F23G 7/08 | 431/4 |
| 4,941,415 | A * | 7/1990 | Pope | F23G 5/16 | 110/211 |
| 5,562,438 | A * | 10/1996 | Gordon | F23C 9/00 | 431/115 |
| 6,269,755 | B1 | 8/2001 | Boswell et al. | | |
| 8,542,987 | B2 * | 9/2013 | Yen | F24B 5/02 | 392/465 |
| 2009/0288583 | A1 * | 11/2009 | Song | F23G 7/065 | 110/212 |
| 2011/0248498 | A1 * | 10/2011 | Tepic | H05B 6/6426 | 290/7 |
| 2012/0036832 | A1 * | 2/2012 | Hoy-Petersen | F02B 29/0437 | 60/274 |
| 2016/0102857 | A1 * | 4/2016 | Khadem | F23C 5/32 | 431/9 |

FOREIGN PATENT DOCUMENTS

| | | | | |
|---|---|---|---|---|
| CN | 2394128 | A | 8/2000 | |
| CN | 1397769 | A | 2/2003 | |
| CN | 102003726 | A | 4/2011 | |
| CN | 205174503 | U | 4/2016 | |
| CN | 205560707 | U | 9/2016 | |
| EP | 1118820 | A1 | 7/2001 | |
| GB | 831712 | A * | 3/1960 | F25J 11/00 |
| JP | H1019245 | A | 1/1998 | |
| JP | 2001174019 | A | 6/2001 | |
| JP | 2005046761 | A | 2/2005 | |
| JP | 6014741 | B1 | 10/2016 | |
| SU | 1113637 | A1 | 9/1984 | |

OTHER PUBLICATIONS

English translation of OA for KR application 10-2018-7037112.
ISR for PCT application PCTCN 2017084771.
English Translation of ISR for PCT application PCTCN 2017084771.
OA for CN application 201611227987.6.
English translation of OA for CN application 201611227987.6.
OA for JP application2019-520188.
The Office Action dated Apr. 21, 2020 corresponding to JP Application No. 2019-520188.

* cited by examiner

FUME EXHAUST ASSEMBLY AND FUME EXHAUST DEVICE

CROSS-REFERENCE TO RELATED APPLICATION

This application is a continuation of international application PCT/CN2017/084771, filed on May 17, 2017, which claims priority to and benefits of Chinese Patent Application Serial No. 201611227987.6, filed with China National Intellectual Property Administration on Dec. 27, 2016, the entire content of which is incorporated herein by reference.

FIELD

The present disclosure relates to a field of fume exhaust, and more particularly to a fume exhaust assembly and a fume exhaust device.

BACKGROUND

In related art, during operation of a fume exhaust device, greasy fume passes through an impeller of a fan, and greasy fume are adhered to the surface of the impeller, which increase load on the impeller and reduces rotating speed, resulting poor fume exhaust effect. At the same time, a motor of the fan generates more heat, which makes it easy to damage.

SUMMARY

Embodiments of the present disclosure provide a fume exhaust assembly and a fume exhaust device.

The fume exhaust assembly according to an embodiment of the present disclosure is used for the fume exhaust device. The fume exhaust assembly includes a fan, a vortex generating portion, a fume intake pipe and a fume exhaust pipe. The vortex generating portion includes a vortex pipe and an air intake channel. The air intake channel is in communication with the vortex pipe, an inlet of the air intake channel is connected to the fan, and an outlet of the air intake channel is configured to generate a vortex updraft in the vortex pipe. The fume intake pipe and the fume exhaust pipe are in communication with the vortex pipe. An outlet of the fume intake pipe is arranged above the outlet of the air intake channel. The outlet of the fume intake pipe is configured to be in communication with a low-pressure zone of the vortex updraft. The fume exhaust pipe is connected to an outlet of the vortex pipe.

With the fume exhaust assembly of the embodiment of the present disclosure, the low-pressure zone of the vortex updraft can suck the outlet of the fume intake pipe, and further suck flow in the fume intake pipe. During operation, greasy fume is sucked into the fume exhaust pipe through the fume intake pipe without passing through an impeller of the fan, i.e. without being adhered to the impeller. The performance of the fan does not become poor because of adhesion of greasy fume. The fume exhausting effect of the fume exhaust assembly can be improved, and meanwhile, the fan is not easy to damage.

In some embodiments, the fume exhaust assembly includes a plurality of air intake tubes, each air intake tube defines the air intake channel, the plurality of air intake tubes penetrate a side wall of the vortex pipe, each air intake tube is straight, and an acute angle is defined between each air intake tube and a tangent at a position where the air intake tube penetrates the vortex pipe.

In some embodiments, the outlet of the air intake channel is defined in an inner surface of the vortex pipe.

In some embodiments, a distance from the outlet of the fume intake pipe to an axial axis of the vortex pipe is not greater than two thirds of a radius of the vortex pipe.

In some embodiments, the air intake channel includes a main channel and a sub channel, the main channel surrounds the vortex pipe, the sub channel makes the main channel in communication with and the vortex pipe, and an outlet of the sub channel is the outlet of the air intake channel.

In some embodiments, the fume exhaust assembly includes a plurality of baffles which are arranged at an inner wall of the vortex pipe, two baffles are arranged at an edge of each outlet of the air intake channel, and an acute angle is defined between each baffle and a tangent at a position where the baffle is arranged on the vortex pipe.

In some embodiments, orientations, defining the acute angle, of the baffles are the same.

In some embodiments, the two baffles arranged at the edge of each outlet of the air intake channel are parallel to each other.

In some embodiments, the vortex pipe includes a vortex introducing pipe and a vortex generating pipe connected to an upper portion of the vortex introducing pipe, the vortex introducing pipe is in communication with the vortex generating pipe, a diameter of the vortex generating pipe is smaller than that of the vortex introducing pipe; the air intake channel is connected to the vortex introducing pipe; the fume intake pipe penetrates the vortex generating pipe; and an output of the vortex generating pipe is the output of the vortex pipe.

In some embodiments, a radius and a height of the vortex introducing pipe are denoted as R and H, respectively, a tangential velocity component and a radial velocity component, at an axial section of the vortex introducing pipe, of the vortex updraft are denoted as Vt and Vr, respectively, a vortex ratio $S=(Vt/Vr)*(R/2H)$, and the vortex ratio S is greater than or equal to 0.2.

In some embodiments, both the vortex introducing pipe and the vortex generating pipe are cylindrical in shape.

In some embodiments, a lower end of the vortex introducing pipe is closed.

The fume exhaust device according to an embodiment of the present disclosure includes the fume exhaust assembly according to any one of above embodiments.

With the fume exhaust assembly of an embodiment of the present disclosure applied in the fume exhaust device of an embodiment of the present disclosure, the low-pressure zone of the vortex updraft can suck the outlet of the fume intake pipe, and further suck flow in the fume intake pipe. During operation, greasy fume is sucked into the fume exhaust pipe through the fume intake pipe without passing through an impeller of the fan, i.e. without being adhered to the impeller. The performance of the fan does not become poor because of adhesion of greasy fume. The fume exhausting effect of the fume exhaust assembly can be improved, and meanwhile, the fan is not easy to damage.

BRIEF DESCRIPTION OF THE DRAWINGS

Embodiments of the present disclosure will become apparent and more readily appreciated from the following descriptions made with reference to the drawings, in which.

Figure 1:
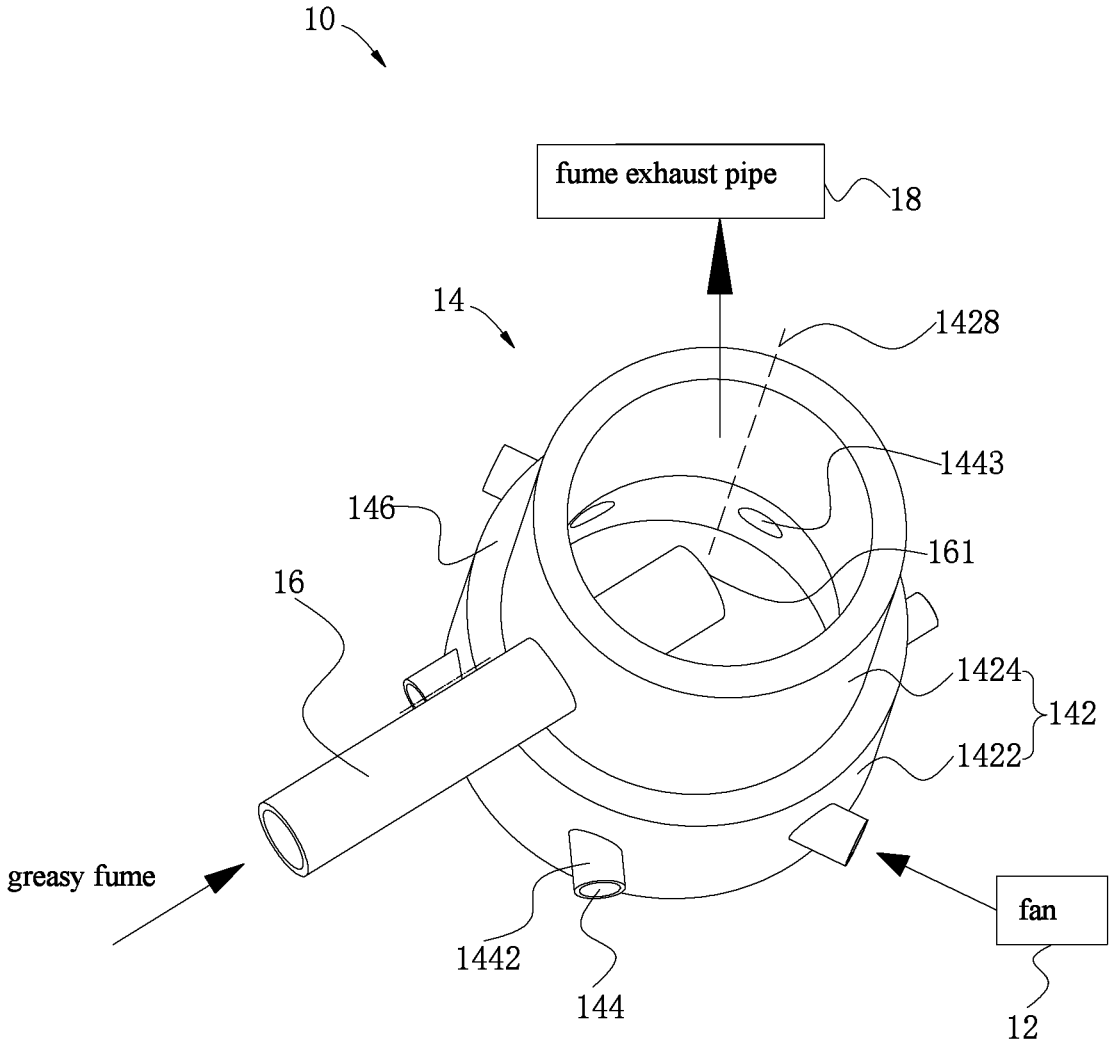
FIG. 1 is a perspective view of a fume exhaust assembly of an embodiment of the present disclosure.

MAIN REFERENCE NUMERALS fume exhaust assembly 10, fan 12, vortex generating portion 14, vortex pipe 142, vortex introducing pipe 1422, vortex generating pipe 1424, axial axis 1428, air intake channel 144; air intake tube 1442, outlet 1443 of air intake channel, main channel 1444, sub channel 1446, baffle 1448, stage 146, fume intake pipe 16, outlet 161 of fume intake pipe, fume exhaust pipe 18.

DETAILED DESCRIPTION

Reference will be made in detail to embodiments of the present disclosure. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

In the specification, it should be understood that, unless specified or limited otherwise, the terms "mounted," "connected," and "coupled," are used broadly, and may be, for example, fixed connections, detachable connections, or integral connections; may also be mechanical or electrical connections, or mutual communication; may also be direct connections or indirect connections via intervening structures; may also be inner communications of two elements or interaction of two elements.

Various different embodiments or examples are provided below to realize different structures of the present disclosure. Components and arrangements of examples are described below for simplifying the present disclosure. Of course, they are examples rather than limit the present disclosure. In addition, reference numerals and/or letters may repeat in different examples of the present disclosure, such repetition is used for simplification and clearness and does not indicate relationship between various embodiments and/or arrangements.

Figure 2:
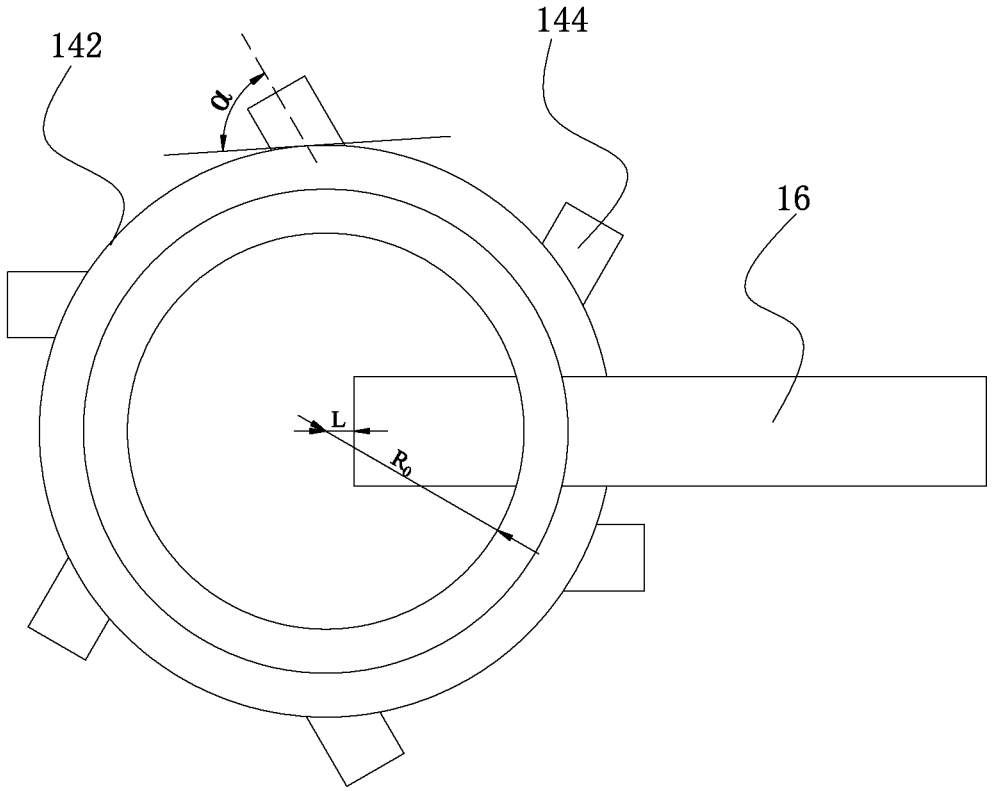
FIG. 2 is a top view of a fume exhaust assembly of an embodiment of the present disclosure.

Please refer to FIG. 1 and FIG. 2, a fume exhaust assembly 10 of an embodiment of the present disclosure is used for a fume exhaust device. The fume exhaust assembly includes a fan 12, a vortex generating portion 14, a fume intake pipe 16, and a fume exhaust pipe 18.

The vortex generating portion 14 includes a vortex pipe 142 and an air intake channel 144. The air intake channel 144 is in communication with the vortex pipe 142, an inlet of the air intake channel 144 is connected to the fan 12, and an outlet 1443 of the air intake channel 144 is configured to generate a vortex updraft in the vortex pipe 142. The fume intake pipe 16 and the fume exhaust pipe 18 are in communication with the vortex pipe (142). An outlet 161 of the fume intake pipe 16 is arranged above the outlet 1443 of the air intake channel 144. The outlet 161 of the fume intake pipe 16 is configured to be in communication with a low-pressure zone of the vortex updraft. The fume exhaust pipe 18 is connected to an outlet of the vortex pipe 142.

With the fume exhaust assembly 10 of the embodiment of the present disclosure, the low-pressure zone of the vortex updraft can suck the outlet 161 of the fume intake pipe 16, and further suck flow in the fume intake pipe 16. During operation, greasy fume is sucked into the fume exhaust pipe 18 through the fume intake pipe 16 without passing through an impeller of the fan 12, i.e. without being adhered to the impeller. The performance of the fan 13 does not become poor because of adhesion of greasy fume. The fume exhausting effect of the fume exhaust assembly 10 can be improved, and meanwhile, the fan 12 is not easy to damage.

In one embodiment, an air flow enters the vortex pipe 142 through the air intake channel 144, the vortex updraft is generated in the vortex pipe 142, and a low-pressure zone is formed in a middle portion of the vortex updraft. Under the action of the low pressure, a greasy fume flow enters the low-pressure zone of the vortex pipe 142. The greasy fume flow and the air flow together flow towards the outlet of the fume exhaust pipe 18, and then are discharged. The greasy fume flow can be discharged without passing through the fan 12, the impeller does not need cleaning, a cost of manual cleaning or an automatic cleaning device added on the fume exhaust assembly 10 can be saved, and meanwhile a system is simpler and more reliable. Furthermore, a pollution area adhered with greasy fume is small, an area where bacteria and insect pests propagate reduces, which is good for a user's health.

In some embodiment, the fume exhaust assembly 10 includes a plurality of air intake tubes 1442, each air intake tube 1442 defines the air intake channel 144. The plurality of air intake tubes 1442 penetrate a side wall of the vortex pipe 142. Each air intake tube 1442 is straight, and an acute angle $\alpha$ is defined between each air intake tube 1442 and a tangent at a position where the air intake tube 1442 penetrates the vortex pipe 142.

Therefore, because an acute angle $\alpha$ is defined between each air intake tube 1442 and the tangent at the position where the air intake tube 1442 penetrates the vortex pipe 142, the air flow forms the vortex updraft in the vortex pipe 142 after entering the vertex pipe 142 through the air intake tubes 1442, such that a negative pressure sucks the greasy fume flow. In one embodiment, the air intake channel 144 is straight, too.

In some embodiments, the outlet 1443 of the air intake channel 144 is defined in an inner surface of the vortex pipe 142.

Therefore, the air flow enters the vortex pipe 142 through the air intake channel 144.

In one embodiment, a portion, outside the vortex pipe 142, of the air intake channel 144 and the vortex pipe 142 defines an angle, the air flow is guide into the vortex pipe 142. Compared with that the outlet 1443 of the air intake channel 144 extends into the vortex pipe 142, a smaller resistance is generated, which facilitates generation of vortex updraft.

In some embodiments, a distance L from the outlet 161 of the fume intake pipe 16 to an axial axis 1428 of the vortex pipe 142 is not greater than two thirds of a radius RO of the vortex pipe 142.

The greasy fume flow is guided to a position with high-negative pressure in the vortex channel 142, thereby exhausting fume in a better way.

In one embodiment, the closer the negative pressure generated by the vortex gets to a center of a vortex, the greater a velocity of the updraft is, and the greater the negative pressure is.

Figure 3:
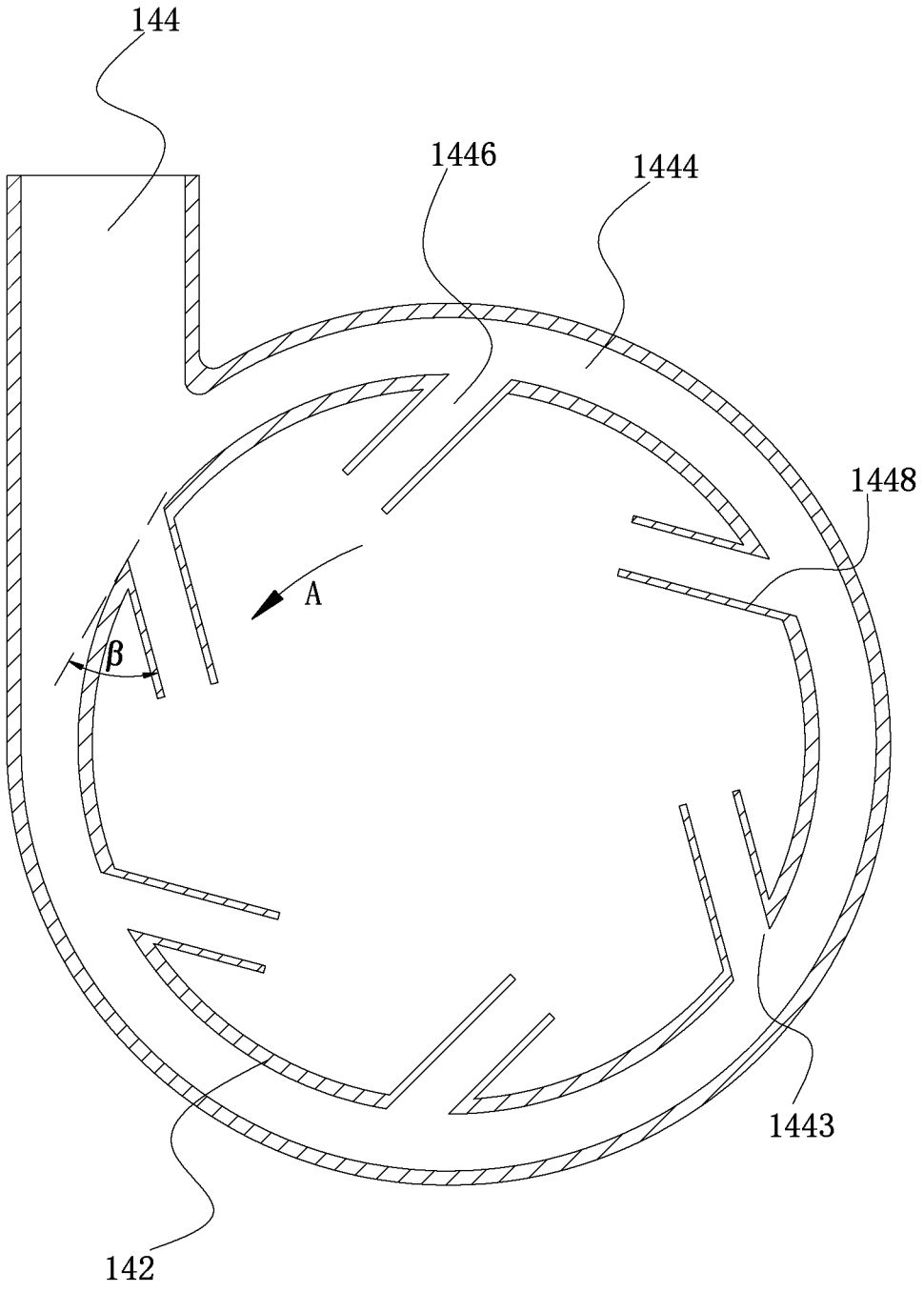
FIG. 3 is a cross-sectional view of a fume exhaust assembly of an embodiment of the present disclosure.

Please refer to FIG. 3, in some embodiments, the air intake channel 144 includes a main channel 1444 and a sub channel 1446, the main channel 1444 surrounds the vortex pipe 142, the sub channel 1446 makes the main channel 1444 in communication with the vortex pipe 142, and an outlet 1443 of the sub channel 1446 is the outlet 1443 of the air intake channel 144.

With arrangement of the main channel 1444 and the sub channel 1446, the air flow can be guided in the vortex pipe 142 to generate vortex updraft and further to generate negative pressure to suck greasy fume.

In one embodiment, the main channel 1444 surrounds the vortex pipe 142, the sub channel 1446 divides air flow in the main channel 1444. In an example of the present disclosure, the outlet 1443 of the sub channel 1446 is defined in an inner surface of the vortex pipe 142, and the outlet is used for communicating the main channel 1444 with the sub channel 1446 to make the air flow enter the vortex pipe 142.

In some embodiment, the fume exhaust assembly 10 includes a plurality of baffles 1448 which are arranged at an inner wall of the vortex pipe 142. Two baffles 1448 are arranged at an edge of each outlet 1443 of the air intake channel 144, an acute angle β is defined between each baffle 1448 and a tangent at a position where the baffle 1448 is arranged on the vortex pipe 142.

Therefore, the baffle 1448 can make the air flow rotate for a long time, which increases the velocity of the air flow and further enhances suction of the vortex updraft.

In one embodiment, orientations A, defining the acute angle, of the baffles 1448 are the same. For example, in an embodiment of the present disclosure, the orientations A, defining the acute angle, of baffles 1448 are all anticlockwise which is the same as a rotating direction of the air flow output from the air intake channel 144. Of course, in other embodiments, clockwise is acceptable.

Furthermore, the two baffles arranged at the edge of each outlet 1443 of the air intake channel 144 are parallel to each other.

Figure 4:
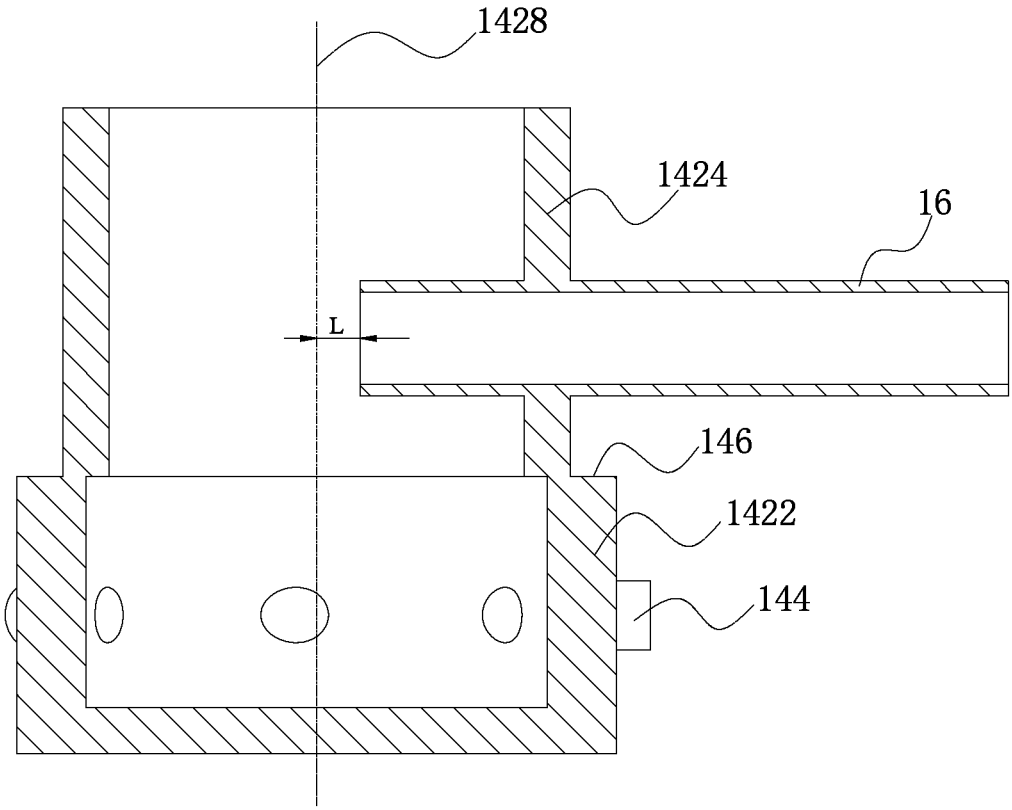
FIG. 4 is a longitudinal-sectional view of a fume exhaust assembly of an embodiment of the present disclosure.

Please refer to FIG. 1, FIG. 2 and FIG. 4, in some embodiments, the vortex pipe 142 includes a vortex introducing pipe 1422 and a vortex generating pipe 1424 connected to an upper portion of the vortex introducing pipe 1422. The vortex introducing pipe 1422 is in communication with the vortex generating pipe 1424. A diameter of the vortex generating pipe 1424 is smaller than that of the vortex introducing pipe 1422.

The air intake channel 144 is connected to the vortex introducing pipe 1422.

The fume intake pipe 16 penetrates the vortex generating pipe 1424.

An output of the vortex generating pipe 1424 is the output of the vortex pipe 142.

Science the diameter of the vortex generating pipe 1424 is smaller than that of the vortex introducing pipe 1422, the vortex updraft can be more conveniently generated in the vortex pipe 142.

In one embodiment, a horizontal stage 146 is arranged at a joint between the vortex generating pipe 1424 and the vortex introducing pipe 1422, and the stage is used for compensating diameter difference between the vortex generating pipe 1424 and the vortex introducing pipe 1422, such that the vortex generating pipe 1424 and the vortex introducing pipe 1422 can be connected together in a closed manner.

In some embodiments, in a case that the vortex pipe 142 includes the vortex introducing pipe 1422 and the vortex generating pipe 1424, a distance L from the outlet 161 of the fume intake pipe 16 to an axial axis 1428 of the vortex pipe 142 is not greater than two thirds of a radius RO of the vortex pipe 142, that is the distance L from the outlet 161 of the fume intake pipe 16 to an axial axis 1428 of the vortex pipe 142 is not greater than two thirds of a radius RO of the vortex generating pipe 1424.

In some embodiments, a radius and a height of the vortex introducing pipe 1422 are denoted as R and H, respectively, a tangential velocity component and a radial velocity component, at an axial section of the vortex introducing pipe 1422, of the vortex updraft are denoted as Vt and Vr, respectively, a vortex ratio $S=(Vt/Vr)*(R/2H)$, and the vortex ratio S is greater than or equal to 0.2.

When the vortex ratio S is greater than or equal to 0.2, the needed negative pressure in the fume exhaust assembly 10 for sucking greasy fume can be met. The dimension of the vortex introduction pipe 1422 can be designed according to the requirement of the vortex ratio S.

In one embodiment, the larger the vortex ratio S, the stronger the vortex, the greater the negative pressure, the greater the suction of the fume exhaust assembly 10, and the better of the fume exhaust effect.

In some embodiments, both the vortex introducing pipe 1422 and the vortex generating pipe 1424 are cylindrical in shape.

Therefore, the vortex introducing pipe 1422 and the vortex generating pipe 1424 have a simple structure. The cylindrical shape is benefit for generation of the vortex updraft, and easy to clean with attractive appearance.

In one embodiment, a lower end of the vortex introducing pipe 1422 is closed.

A fume exhaust device of an embodiment of the present disclosure includes the fume exhaust assembly 10 according to any one of the above embodiments.

With the fume exhaust assembly 10 of an embodiment of the present disclosure applied in the fume exhaust device of an embodiment of the present disclosure, the low-pressure zone of the vortex updraft can suck the outlet 161 of the fume intake pipe 16, and further suck flow in the fume intake pipe 16. During operation, greasy fume is sucked into the fume exhaust pipe 18 through the fume intake pipe 16 without passing through an impeller of the fan 12, i.e. without being adhered to the impeller. The performance of the fan 13 does not become poor because of adhesion of greasy fume. The fume exhausting effect of the fume exhaust assembly 10 can be improved, and meanwhile, the fan 12 is not easy to damage.

Reference throughout this specification to "an embodiment," "some embodiments," "illustrative embodiment", "an example," "a specific example," or "some examples," means that a particular feature, structure, material, or characteristic described in connection with the embodiment or example is included in at least one embodiment or example of the present disclosure. Thus, the appearances of the phrases are not necessarily referring to the same embodiment or example of the present disclosure. Furthermore, the particular features, structures, materials, or characteristics may be combined in any suitable manner in one or more embodiments or examples.

What is claimed is:

1. A fume exhaust assembly, comprising:

a fan;

a vortex generating portion, the vortex generating portion comprising a vortex pipe and an air intake channel, the air intake channel being in communication with the vortex pipe, an inlet of the air intake channel being connected to the fan, and an outlet of the air intake channel being configured to generate a vortex updraft in the vortex pipe;

a fume intake pipe and a fume exhaust pipe being in communication with the vortex pipe, an outlet of the fume intake pipe being arranged above the outlet of the air intake channel, the outlet of the fume intake pipe being configured to be in communication with a low-pressure zone of the vortex updraft, and the fume exhaust pipe being connected to an outlet of the vortex pipe; and a plurality of baffles which are arranged at an inner wall of the vortex pipe, two baffles are arranged at an edge of each outlet of the air intake channel, an acute angle is defined between each baffle and a tangent at a position where the baffle is arranged on the vortex pipe;

wherein the air intake channel includes a main channel and a sub channel, the main channel surrounds the vortex pipe, the sub channel makes the main channel in communication with the vortex pipe, and an outlet of the sub channel is the outlet of the air intake channel.

2. The fume exhaust assembly according to claim 1, wherein the fume exhaust assembly comprises a plurality of air intake tubes, each air intake tube defining the air intake channel, the plurality of air intake tubes penetrate a side wall of the vortex pipe, each air intake tube is straight, and an acute angle being defined between each air intake tube and a tangent at a position where the air intake tube penetrates the vortex pipe.

3. The fume exhaust assembly according to claim 1, wherein the outlet of the air intake channel is defined in an inner surface of the vortex pipe.

4. The fume exhaust assembly according to claim 1, wherein a distance from the outlet of the fume intake pipe to an axial axis of the vortex pipe is not greater than two thirds of a radius of the vortex pipe.

5. The fume exhaust assembly according to claim 1, wherein orientations, defining the acute angle, of the baffles are the same.

6. The fume exhaust assembly according to claim 1, wherein the two baffles arranged at the edge of each outlet of the air intake channel are parallel to each other.

7. The fume exhaust assembly according to claim 1, wherein the vortex pipe includes a vortex introducing pipe and a vortex generating pipe connected to an upper portion of the vortex introducing pipe, the vortex introducing pipe is in communication with the vortex generating pipe, a diameter of the vortex generating pipe is smaller than that of the vortex introducing pipe; the air intake channel is connected to the vortex introducing pipe; the fume intake pipe penetrates the vortex generating pipe; and an output of the vortex generating pipe is the output of the vortex pipe.

8. The fume exhaust assembly according to claim 7, wherein a radius and a height of the vortex introducing pipe are denoted as R and H, respectively, a tangential velocity component and a radial velocity component, at an axial section of the vortex introducing pipe, of the vortex updraft are denoted as Vt and Vr, respectively, a vortex ratio $S=(Vt/Vr)*(R/2H)$, and the vortex ratio S is greater than or equal to 0.2.

9. The fume exhaust assembly according to claim 7, wherein both the vortex introducing pipe and the vortex generating pipe are cylindrical in shape.

10. The fume exhaust assembly according to claim 9, wherein a lower end of the vortex introducing pipe is closed.

11. A fume exhaust device, comprising:

a fume exhaust assembly, comprising:

a fan;

a vortex generating portion, the vortex generating portion comprising a vortex pipe and an air intake channel, the air intake channel being in communication with the vortex pipe, an inlet of the air intake channel being connected to the fan, and an outlet of the air intake channel being configured to generate a vortex updraft in the vortex pipe; and a fume intake pipe and a fume exhaust pipe being in communication with the vortex pipe, an outlet of the fume intake pipe being arranged above the outlet of the air intake channel, the outlet of the fume intake pipe being configured to be in communication with a low-pressure zone of the vortex updraft, and the fume exhaust pipe being connected to an outlet of the vortex pipe; and a plurality of baffles which are arranged at an inner wall of the vortex pipe, two baffles are arranged at an edge of each outlet of the air intake channel, an acute angle is defined between each baffle and a tangent at a position where the baffle is arranged on the vortex pipe;

wherein the air intake channel includes a main channel and a sub channel, the main channel surrounds the vortex pipe, the sub channel makes the main channel in communication with the vortex pipe, and an outlet of the sub channel is the outlet of the air intake channel.

* * * * *